US010709270B2

(12) United States Patent
Joseph et al.

(10) Patent No.: US 10,709,270 B2
(45) Date of Patent: Jul. 14, 2020

(54) LID ASSEMBLY FOR A CONTAINER

(71) Applicant: IGNITE USA, LLC, Chicago, IL (US)

(72) Inventors: David Joseph, St. Charles, IL (US); Blair Miller, Chicago, IL (US); Paul D. Hurley, Libertyville, IL (US); Todd Starr, St. Joseph, MI (US)

(73) Assignee: IGNITE USA, LLC, Chicago, IL (US)

( * ) Notice: Subject to any disclaimer, the term of this patent is extended or adjusted under 35 U.S.C. 154(b) by 1105 days.

(21) Appl. No.: 15/062,950

(22) Filed: Mar. 7, 2016

(65) Prior Publication Data

US 2016/0255973 A1 Sep. 8, 2016

Related U.S. Application Data

(60) Provisional application No. 62/129,521, filed on Mar. 6, 2015.

(51) Int. Cl.

| | |
|---|---|
| ***A47G 19/22*** | (2006.01) |
| ***B65D 43/02*** | (2006.01) |
| ***B65D 47/20*** | (2006.01) |

(52) U.S. Cl.

CPC ..... *A47G 19/2272* (2013.01); *B65D 43/0229* (2013.01); *B65D 47/20* (2013.01)

(58) Field of Classification Search

CPC . A47G 19/2272; B65D 43/0229; B65D 47/20

(Continued)

(56) References Cited

U.S. PATENT DOCUMENTS 6,010,029 A * 1/2000 Wang ..... B65D 47/265 220/254.4
D547,611 S * 7/2007 Seum ..... D7/510

(Continued)

FOREIGN PATENT DOCUMENTS

CN 203186774 U 9/2013
EP 2 567 909 A1 3/2013

OTHER PUBLICATIONS

Starbucks® Store, Stainless Steel Tumbler—Matte Black, 16 fl oz. Retrieved from the Internet: <<http://store.starbucks.com/stainless-steel-tumbler-matte-black-16-fl-oz-011043751.html?navid-tumblers-and-travel-mugs&start=1>>, applicant's internal files, admitted prior art.

(Continued)

*Primary Examiner* — Ernesto A Grano
(74) *Attorney, Agent, or Firm* — Marshall, Gerstein & Borun LLP

(57) ABSTRACT

A lid assembly adapted to be removably secured to a container includes a base portion having a fluid aperture, and a ridge portion extends from a top surface of the base portion. A button member is coupled to the base portion, and depressing the button member from a closed position to an open position displaces a seal member of a seal assembly away from the fluid aperture so that fluids may pass from the interior of the container through the fluid aperture. A locking assembly includes a cover portion coupled to the base portion, and when the cover portion is in a locked position, an engagement portion engages a recess on the button member to prevent displacement out of the closed position. When the cover portion is rotated into an unlocked position, the engagement portion disengages the recess, thus allowing the button member to displace to the open position.

18 Claims, 12 Drawing Sheets

(58) Field of Classification Search
USPC ..... 215/254.3
See application file for complete search history.

(56) References Cited

U.S. PATENT DOCUMENTS

| | | | | |
|---|---|---|---|---|
| 7,513,380 | B2 * | 4/2009 | Canedo | A45F 3/18 220/230 |
| D627,192 | S | 11/2010 | Gilbert et al. | |
| 8,360,258 | B2 | 1/2013 | Gilbert et al. | |
| D675,873 | S * | 2/2013 | Miller | D7/510 |
| D676,278 | S * | 2/2013 | Wong | D7/510 |
| 8,464,895 | B2 * | 6/2013 | Gilbert | A47G 19/2272 215/307 |
| 9,462,904 | B2 * | 10/2016 | Coon | A45F 3/18 |
| D787,885 | S * | 5/2017 | Rummel | D7/510 |
| D789,149 | S * | 6/2017 | Rummel | D7/510 |
| D798,665 | S * | 10/2017 | Rummel | D7/510 |
| D799,899 | S * | 10/2017 | Rummel | D7/510 |
| 9,873,554 | B2 * | 1/2018 | Choltco-Devlin | B65D 43/26 |
| 10,023,366 | B2 * | 7/2018 | Gilbert | A47G 19/2272 |
| 10,035,629 | B2 * | 7/2018 | Gilbert | A47G 19/2272 |
| D827,377 | S * | 9/2018 | Silsby | D7/510 |
| 10,071,838 | B2 * | 9/2018 | Gilbert | A47G 19/2272 |
| 10,077,144 | B2 * | 9/2018 | Gilbert | A47G 19/2272 |
| 10,227,166 | B2 * | 3/2019 | Gilbert | A47G 19/2272 |
| 10,232,987 | B2 * | 3/2019 | Gilbert | A47G 19/2272 |
| 10,259,620 | B2 * | 4/2019 | Matthis | A47G 19/2272 |
| D850,209 | S * | 6/2019 | Silsby | D7/510 |
| 2006/0226160 | A1 * | 10/2006 | Elsaden | A47G 19/2272 220/715 |
| 2007/0210093 | A1 * | 9/2007 | Pinelli | A47G 19/2272 220/715 |
| 2013/0119060 | A1 | 5/2013 | Chiou et al. | |
| 2015/0060448 | A1 | 3/2015 | Coon et al. | |
| 2015/0201776 | A1 * | 7/2015 | Elsaden | A47G 19/2272 220/715 |
| 2016/0264311 | A1 * | 9/2016 | Gilbert | A47G 19/2272 |

OTHER PUBLICATIONS

English translation of Office Action for corresponding Chinese Patent Application No. 201610128370.2, dated Oct. 25, 2018.

European Search Report for Application No. 16159012.0-1653, dated Aug. 1, 2016.

* cited by examiner

LID ASSEMBLY FOR A CONTAINER

CROSS REFERENCE TO RELATED APPLICATION

This application claims the benefit under 35 U.S.C. §119 (e) of U.S. provisional patent application Ser. No. 62/129,521, filed Mar. 6, 2015, the entire disclosure of which is incorporated herein by reference, is hereby claimed.

FIELD OF THE DISCLOSURE

This disclosure relates generally to a lid assembly for containers, and more particularly, to a re-closable lid assembly for beverage containers.

BACKGROUND

Refillable beverage containers, such as commuter coffee mugs, for example, typically include a removable lid that includes a fluid aperture, and a user typically fills the interior of the container (e.g., an insulated container) with a beverage (e.g., coffee) when the lid is removed. To drink the beverage, the user typically tips the container to allow the beverage to pass through the fluid aperture, and the user sips the beverage as the beverage exits the fluid aperture. Because the beverage may be very hot, it is desired to prevent the beverage from spilling out of the fluid aperture if the container is accidentally tipped. Accordingly, refillable beverage containers can include a selective locking device on the lid that allows fluid to pass through the fluid aperture only when the locking device is in a desired position. A typical locking mechanism includes a lever or button that is displaced by the user prior to (or while) sipping the beverage. However, if such a refillable beverage container is carried in a bag with other items, contact between the items within the bag and the lever or button may accidentally disengage the locking mechanism and cause the beverage to pass through the fluid aperture and onto the items in the bag. Moreover, typical refillable beverage containers have a drinking area adjacent to or surrounding the fluid aperture that can become dirty with contact from the debris within the bag. Consequently, there is a need for a removable lid having a locking mechanism that cannot be accidentally depressed and that is easy to lock and unlock. There is also a need for a cover to protect the fluid aperture when the refillable beverage container is stored but that allows access to the fluid aperture when the user desires to drink the beverage.

BRIEF SUMMARY OF THE DISCLOSURE

A lid assembly adapted to be removably secured to a container includes a base portion having a top surface having a top perimeter edge and a bottom surface having a bottom perimeter edge, and a fluid aperture extends through the base portion from the top surface to the bottom surface. An button member is coupled to the base portion, the button member extending along a longitudinal axis from a first end to a longitudinally-opposite second end, the button member being displaceable along the longitudinal axis from a closed first position to an open second position. The button member has a first locking engagement portion disposed between the first end and the second end. The lid assembly also includes a displaceable seal assembly coupled to the base portion and displaceable from a closed first position to an open second position, the displaceable seal assembly including a first portion having a seal member, the seal member adapted to sealingly engage a portion of the fluid aperture when the displaceable seal assembly is in the closed second position and adapted to not sealingly engage the portion of the fluid aperture when the displaceable seal assembly is in the open first position. The displaceable seal assembly also includes a second portion coupled to the first portion, the second portion adapted to be contacted by the first end of the button member such that when the button member displaces from the closed first position to the open second position, the first end of the button member contacts the second portion of the displaceable seal assembly and translates the displaceable seal assembly from the closed second position to the open first position. The lid assembly also includes a locking assembly that has a cover portion rotatably coupled to the base portion, the cover portion having a central portion and an edge portion disposed around a perimeter edge of the central portion. The central portion has a top surface and a bottom surface, and the cover portion is rotationally displaceable relative to the base portion from an unlocked first position to a locked second position about a lid axis. The cover portion is coupled to a second locking engagement portion, and at least a portion of the second locking engagement portion is engaged with a portion of the first locking engagement portion of the button member when the cover portion is in the locked second position such that displacement of the button member from the closed first position towards the open second position is prevented or limited, thereby advantageously preventing the inadvertent or accidental displacement of the seal assembly from the closed first position to the open second position. In addition, no portion of the second locking engagement portion is engaged with the portion of the first locking engagement portion of the button member when the cover portion is in the unlocked first position such that the button member is adapted to be selectively displaced by the consumer from the closed first position to the open second position to displace the seal assembly from the closed first position to the open second position.

DETAILED DESCRIPTION

Figure 1:
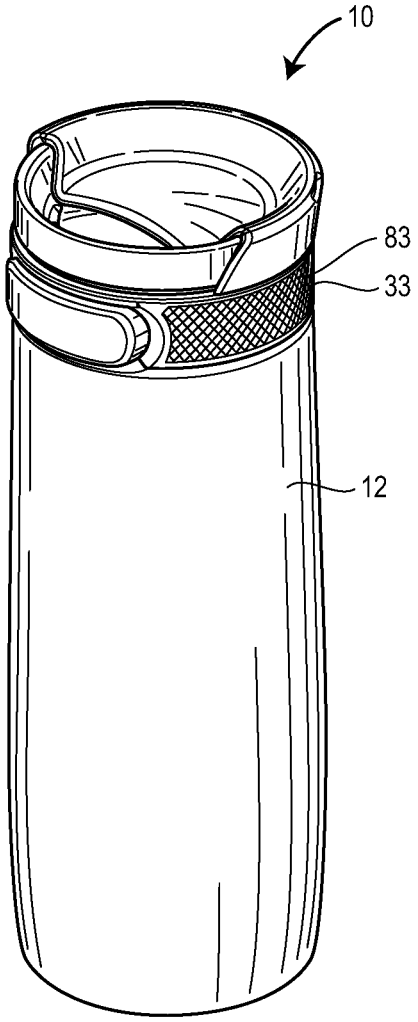
FIG. 1 is a perspective view of an embodiment of a lid assembly removably secured to a container.

As illustrated in FIG. 1, a lid assembly 10 may be adapted to be removably secured to a container 12. Referring to FIGS. 2A and 2B, the lid assembly 10 may include a base portion 14 having a top surface 16 having a top perimeter edge 18 and a bottom surface 20 having a bottom perimeter edge 22. A fluid aperture 24 may extend through the base portion 14 from the top surface 16 to the bottom surface 20. A skirt portion 30 may extend from the bottom perimeter edge 22 of the bottom surface 20 of the base portion 14. The skirt portion 30 may have an exterior surface 62, and a portion of the exterior surface 62 of the skirt portion is threaded and adapted to engage a threaded portion (not shown) of the container 12. A button aperture 31 may be defined in the skirt portion, and the button aperture may extend along a button axis 64. A ridge portion 32 may extend from the top perimeter edge 18 of the top surface of the base portion 14.

Figure 3A:
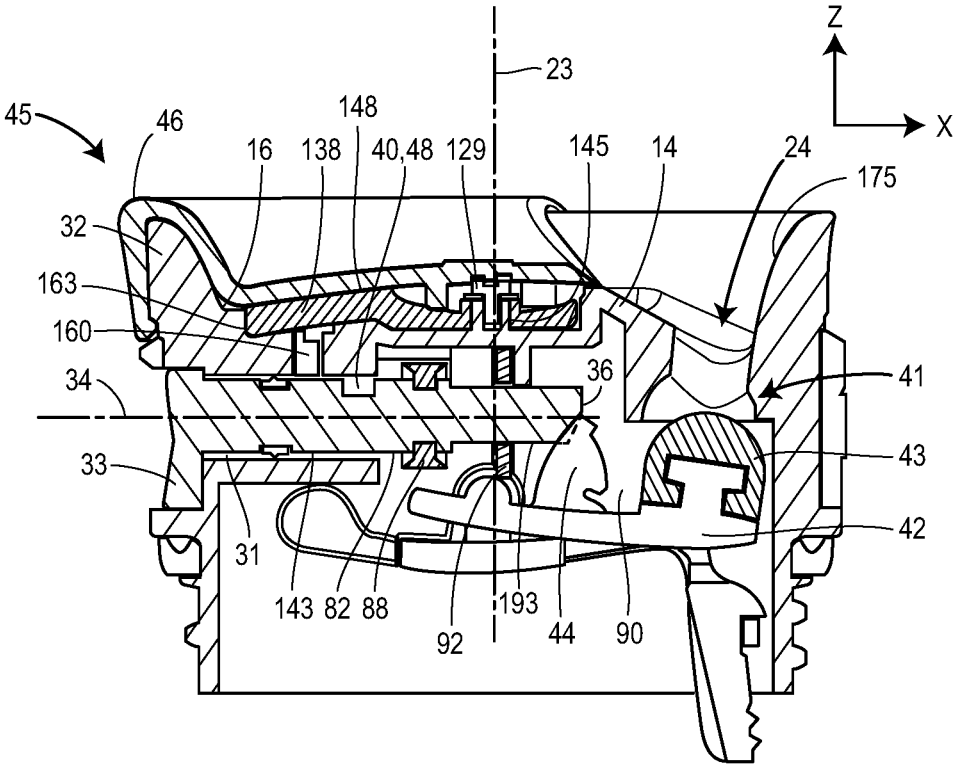
FIG. 3A is a cross-sectional view of an embodiment of the lid assembly with a button member in an open second position, the displaceable seal assembly in an open second position, and the cover portion in an unlocked first position.
Figure 3B:
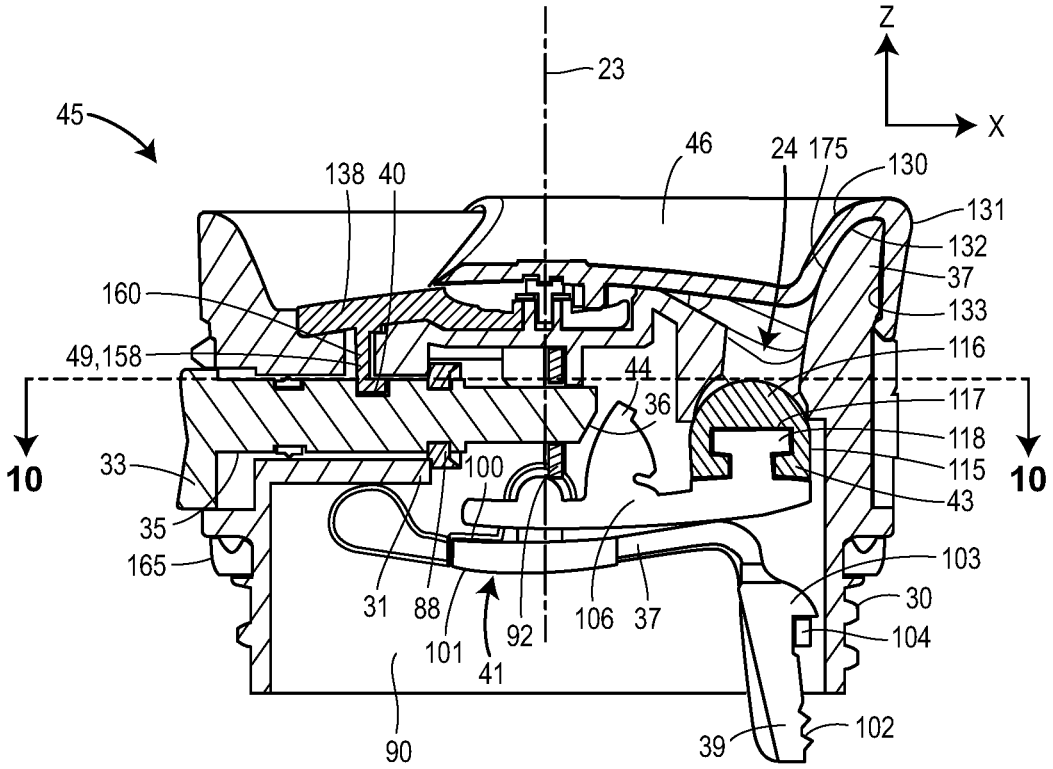
FIG. 3B is a cross-sectional view of the embodiment of the lid assembly of FIG. 3A with the button member in a closed first position, the displaceable seal assembly in a closed first position, and the cover portion in a locked second position.
Figure 4:
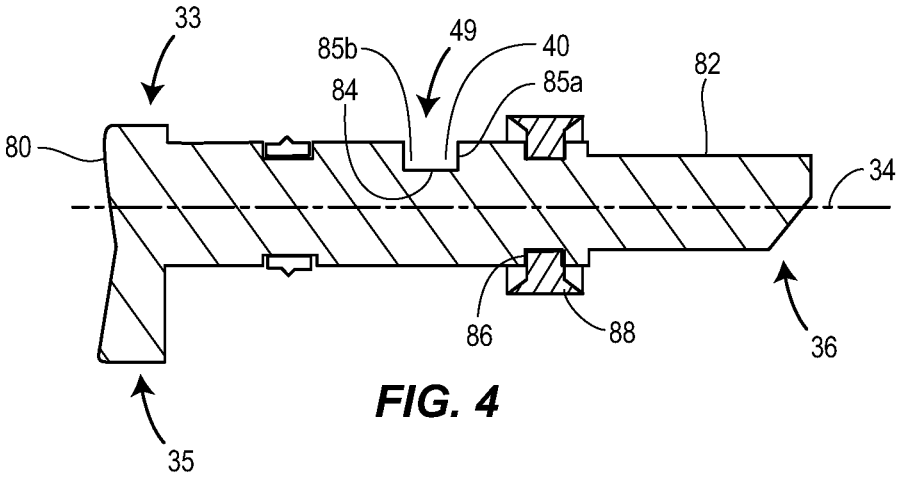
FIG. 4 is a cross-sectional side view of an embodiment of the button member.

As illustrated in FIGS. 3A, 3B, and 4, the lid assembly 10 may also include a button member 33 that may extend along a longitudinal axis 34 from a first end 36 to a longitudinally-opposite second end 35, and the button member 33 may be displaceable along the longitudinal axis 34 from a closed first position (illustrated in FIG. 3B) to an open second position (illustrated in FIG. 3A), and at least a portion of the button member 33 is disposed within the button aperture 31. The button member 33 may have a first locking engagement portion 49 (e.g., a locking recess 40) disposed between the first end 36 and the second end 35.

As illustrated in FIGS. 3A and 3B, the lid assembly 10 may further include a displaceable seal assembly 41 coupled to the base portion 14 and displaceable from a closed first position (illustrated in FIG. 3B) to an open second position (illustrated in FIG. 3A). The displaceable seal assembly 41 includes a first portion 42 having a seal member 43, the seal member 43 adapted to sealingly engage a portion of the fluid aperture 24 when the displaceable seal assembly 41 is in the closed first position and adapted to not sealingly engage the portion of the fluid aperture 24 when the displaceable seal assembly 41 is in the open second position. The displaceable seal assembly 41 also includes a second portion 44 coupled to the first portion 42, the second portion 44 being adapted to be contacted by the first end 36 of the button member 33 such that when the button member 33 displaces from the closed first position to the open second position, the first end 36 of the button member 33 contacts the second portion 42 of the displaceable seal assembly 41 (as illustrated in FIG. 3A) and translates the displaceable seal assembly 41 from the closed first position to the open second position.

Figure 7B:
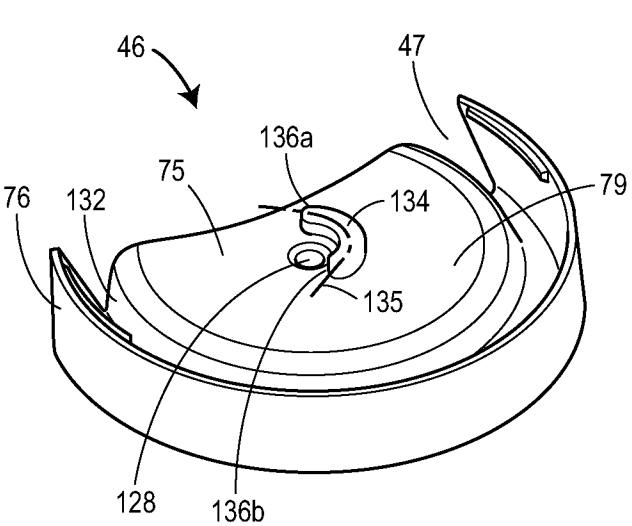
FIG. 7B is a perspective bottom view of the embodiment of FIG. 7A.
Figure 7A:
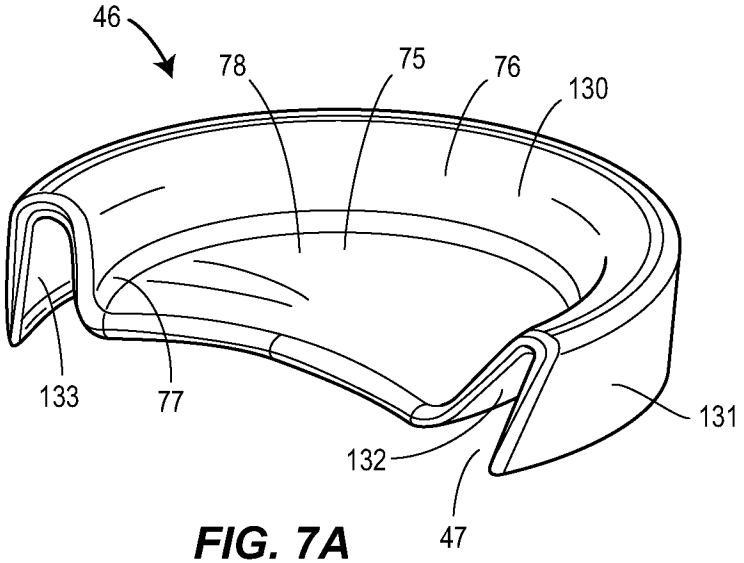
FIG. 7A is a perspective top view of an embodiment of a cover portion of the lid assembly.
Figure 7C:
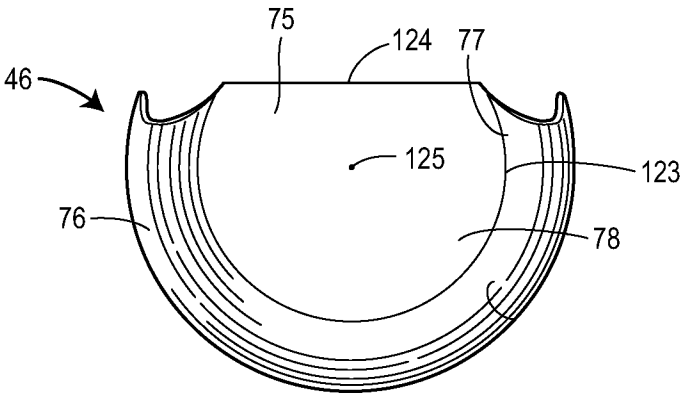
FIG. 7C is a top view of the embodiment of FIG. 7A.

As illustrated in FIGS. 3A and 3B, the lid assembly 10 may also include a locking assembly 45 including a cover portion 46 rotatably coupled to the base portion 14. As illustrated in FIGS. 7A and 7B, the cover portion 45 may have a central portion 75 and an edge portion 76 disposed around a perimeter edge 77 of the central portion 75, and the central portion 75 may have a top surface 78 and a bottom surface 79. The cover portion 46 may be rotationally displaceable relative to the base portion 14 from an unlocked first position (illustrated in FIG. 3A) to a locked second position (illustrated in FIG. 3B) about a lid axis 23. At least a portion of the ridge portion 32 (illustrated in FIG. 2A) may be received into a channel 47 formed by the edge portion 76, and the cover portion 46 may be coupled to a second locking engagement portion 48 (illustrated in FIG. 3A).

So configured, and as illustrated in FIG. 3B, at least a portion of the second locking engagement portion 48 may be engaged with a portion of the first locking engagement portion 49 (e.g., disposed within a portion of the locking recess 40) of the button member 33 when the cover portion 46 is in the locked second position such that displacement of the button member 33 from the closed first position towards the open second position is prevented or limited, thereby preventing the accidental or inadvertent displacement of the seal assembly 41 from the closed first position to the open second position. In addition, as illustrated in FIG. 3A, no portion of the second locking engagement portion 48 (not shown in this view) is engaged with a portion of the first locking engagement portion 49 (e.g., disposed within a portion of the locking recess 40) of the button member 33 when the cover portion 46 is in the unlocked first position such that the button member 33 is adapted to be displaced from the closed first position to the open second position to displace the seal assembly 41 from the closed first position to the open second position.

Accordingly, because the cover portion 46 must be rotated from the locked second position to the unlocked first position to allow the button member 33 to be depressed to trigger the displaceable seal assembly 41, fluid within the container 12 cannot be accidentally discharged through the fluid aperture 24 by an inadvertent force on the button member 33. In addition, a user can quickly and easily rotate the cover portion 46 from the unlocked first position to the locked second position to prevent accidental actuation of the button member 33. Moreover, when the cover portion 46 is in the locked second position, a portion 175 of the ridge portion 32 (see FIG. 3B) adjacent to the fluid aperture 24 is covered by the cover portion 46, thereby advantageously keeping the drinking area (i.e., an area adjacent to the fluid aperture 24 and/or the portion 175 of the ridge portion 32) clean and free of debris.

Figure 2C:
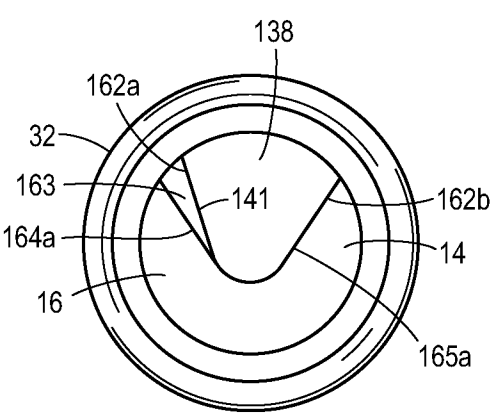
FIG. 2C is a top view of an embodiment of a base portion and an intermediate portion with the cover portion omitted for clarity.
Figure 2B:
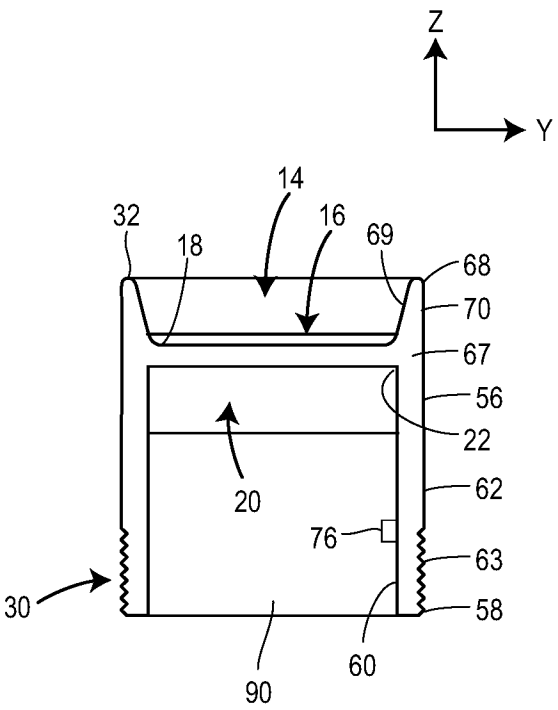
FIG. 2B is a cross-sectional view along line 2B-2B of the embodiment of FIG. 2A.
Figure 2A:
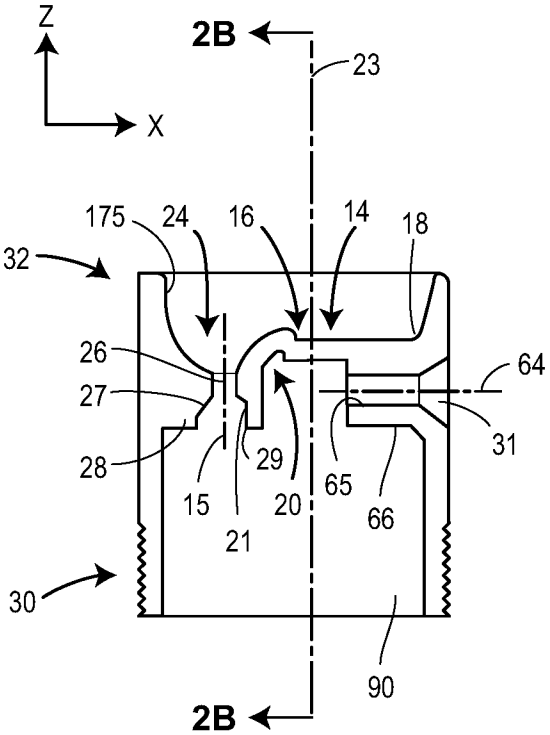
FIG. 2A is a cross-sectional view of an embodiment of a base portion of the lid assembly.

Turning to the lid assembly 10 in more detail, and referring to FIGS. 2A to 2C, the base portion 14 includes the top surface 16 having a top perimeter edge 18 and the bottom surface 20 having a bottom perimeter edge 22. The base portion 14 may generally extend in a direction normal to the lid axis 23, and the lid axis 23 may extend in a vertical (i.e., along or parallel to the Z-axis of the reference coordinate system of FIGS. 2A and 2B) or substantially vertical direction. The top surface 16 and the bottom surface 20 may have any suitable shape or combination of shapes to allow the base portion 14 to act as a support for the button member 33 and/or the displaceable seal assembly 41 and to provide a barrier between the interior of the container 12 and the outside of the lid assembly 10. For example, all or a portion of the bottom surface 20 and/or the top surface 16 may be planar. In some embodiments, all or a portion of the bottom surface 20 and/or the top surface 16 may be planar and may be horizontal (i.e., normal to the Z-axis of the reference coordinate system of FIGS. 2A and 2B) or substantially horizontal. In addition, one or more portions of the bottom surface 20 and/or the top surface 16 may be non-planar and may be curved or otherwise contoured. The top perimeter edge 18 and the bottom perimeter edge 22, each defining the top surface 16 and the bottom surface 20, respectively, of the base portion 14, may have any suitable shape or combination of shapes. For example, the top perimeter edge 18 and the bottom perimeter edge 22 may each be circular, and each of the top perimeter edge 18 and the bottom perimeter edge 22 may be coaxially-aligned with the lid axis 23. The base portion 14 may be a single part or may be an assembly of two or more parts that cooperate to form the base portion 14.

A fluid aperture 24 may extend through the base portion 14 from the top surface 16 to the bottom surface 20. In addition, a portion of the fluid aperture 24 may be provided by a boss 28 extending from the bottom surface 20 of the base portion 14, and an inner surface 21 of the boss 28 may define the portion of the fluid aperture 24. The fluid aperture 24 may have any suitable cross-sectional shape or combination of shapes, provided that it permits fluid flow therethrough. For example, the fluid aperture 24 may have the cross-sectional shape (when viewed along a vertical reference axis 25 disposed within the fluid aperture 24 or a portion of the fluid aperture 24) of a circle or that of an oval. The cross-sectional shape may be constant along the vertical reference axis 25 or may vary along one or more portions of the reference axis 25. For example, the fluid aperture 24 may have a first portion 26 that may have a constant or substantially constant cross-sectional shape (when viewed along a vertical reference axis 25) and a second portion 27 that has a cross-sectional shape that increases along the vertical reference axis 25 from an end portion of the first portion 26 to an end portion 29 of the fluid aperture 24 (e.g., an end portion of the boss 28).

As illustrated in FIGS. 2A and 2B, the lid assembly 10 may also include the skirt portion 30 that may extend from the bottom surface 20 of the base portion 14. The skirt portion 30 may extend along the lid axis 23 from a first end 56 at or adjacent to the bottom surface 20 to an open second end 58. The skirt portion 30 may be at least partially defined by an interior surface 60 and an exterior surface 62, and the exterior surface 62 may be outwardly offset (in a direction away from the lid axis 23) from the interior surface 60 when viewed along the lid axis 23. The interior surface 60 of the skirt portion 30 and the bottom surface 20 of the base portion 14 may at least partially define a skirt interior 90. In some embodiments, the skirt portion 30 may extend from the bottom perimeter edge 22 of the bottom surface 20 of the base portion 14, and a cross-sectional shape of the skirt portion 30 (when viewed normal to the lid axis 23) may correspond to the shape of the bottom perimeter edge 22 (when viewed normal to the lid axis 23). In some embodiments, the interior surface 60 and/or the exterior surface 62 of the skirt portion 30 may be cylindrical. A portion 63 of the exterior surface 62 of the skirt portion is threaded and adapted to engage a threaded portion (not shown) of the container 12 in a known manner. As illustrated in FIG. 3B, a circumferential seal 165 may extend around a portion of the exterior surface 62 of the skirt portion 30 above the threaded portion 63 to prevent leakage when the lid assembly 10 is secured to the container 12.

Referring again to FIGS. 2A and 2B, the button aperture 31 may be defined in the skirt portion 30, and the button aperture may be adapted to receive a portion of the button member 33 in a manner that will be described in more detail. The button aperture 31 may extend along the button axis 64, and the button axis 64 may be normal to (and may intersect) the lid axis 23. The button aperture 31 may be partially defined by an inner surface 65 of a projection 66 that may extend along the button axis 64. The inner surface 65 may have any suitable shape, and may be cylindrical. That is, the inner surface 65 may have a cross-sectional shape that may be circular, and may be constant or substantially constant along the button axis 64.

As illustrated in FIG. 2B, the lid assembly 10 may also include a ridge portion 32 that may extend from the top surface 16 of the base portion 14. The ridge portion 32 may extend along the lid axis 23 from an open first end 67 to a second end 68 at or adjacent to the top surface 16 of the base member 14. The ridge portion 32 may be at least partially defined by an interior surface 69 and an exterior surface 70, and the exterior surface 70 may be outwardly offset (in a direction away from the lid axis 23) from the interior surface 69 when viewed along the lid axis 23. In some embodiments, the ridge portion 32 may extend from the top perimeter edge 18 of the top surface 16 of the base portion 14, and a cross-sectional shape of the ridge portion 32 (when viewed normal to the lid axis 23) may correspond to the shape of the top perimeter edge 18 (when viewed normal to the lid axis 23). In some embodiments, the interior surface 69 and/or the exterior surface 70 of the ridge portion 32 may be cylindrical or generally cylindrical. That is, the interior surface 69 and/or the exterior surface 70 of the ridge portion 32 may have a circular cross-sectional shape when viewed along the lid axis 23. However, the diameter of the circle corresponding to the interior surface 69 and/or the exterior surface 60 of the ridge portion 32 may vary along the lid axis 23. For example, the exterior surface 70 may have a slight concave shape and the interior surface 69 may have a slight convex shape. Of course, other shapes are also possible.

As illustrated in FIGS. 2B and 4, the lid assembly 10 may also include the button member 33 extending along the longitudinal axis 34 from the first end 36 to the second end 35, and the button member 33 may be elongated along the longitudinal axis 34. The button member 33 may have an interface portion 80 at or adjacent to the second end 35 and a main portion 82 extending from the interface portion to the first end 36. The interface portion 80 may have a height and width that is each greater than a corresponding height and width of the main portion 82. The interface portion 80, as illustrated in FIG. 1, may have a contoured or curved outer surface 83 that may generally correspond to the curvature of the exterior surface 62 of the skirt portion 30. The interface portion 80 may be dimensioned and positioned to be engaged by one or more fingers of a user to inwardly depress the button member 33 to translate the button member 33 from the closed first position to the open second position. The main portion 82 may have any suitable cross sectional shape or combination of shapes. For example, the main portion 82 may be cylindrical or substantially cylindrical.

Still referring to FIG. 4, the first locking engagement portion 49 may be formed over a portion (or the entire) circumference of the main portion 82. Specifically, the first locking engagement portion 49 may be a locking recess 40 may be formed over a portion (or the entire) circumference of the main portion 82, and the locking recess 40 may include a pair of opposed side walls 85*a*, 85*b* and a bottom wall 84. The locking recess 40 may be sized to receive all or part of the engagement portion 48 in a manner that will be described in more detail in a following section. The skilled person would recognize that the first locking engagement portion 49 may include any feature or combination of features that can engage with the second locking engagement portion 48 to prevent or limit displacement of the button member 33 from the closed first position to (or towards) the open second position. For example, the first locking engagement portion 49 may be a projection or tab that may be received in a second locking engagement portion 48 that may be a recess or channel.

The main portion 82 may also include a seal recess 86 that may be formed over a portion (or the entire) circumference of the main portion 82. The seal recess 86 may be disposed between the locking recess 40 and the first end 36 of the button member 33. A circumferential seal 88 may be disposed within the seal recess 86 and extend radially beyond the seal recess 86. The seal 88 may be sized and positioned such that when the button member is in the closed first position (illustrated in FIG. 3B), the seal 88 abuts and sealingly engages an end portion of the button aperture 31, thereby preventing leaks through the button aperture 31. The button member 33 may be displaceable along the longitudinal axis 34 from the closed first position to the open second position, and the longitudinal axis 34 may be coaxially aligned with the button axis 64 of the button aperture 31 (illustrated in FIG. 2A). The longitudinal axis 34 may be normal to the lid axis 23 and may intersect the lid axis 23 (i.e., the longitudinal axis may be parallel to the X-axis of the reference coordinate system of FIGS. 3A and 3B).

Figure 8A:
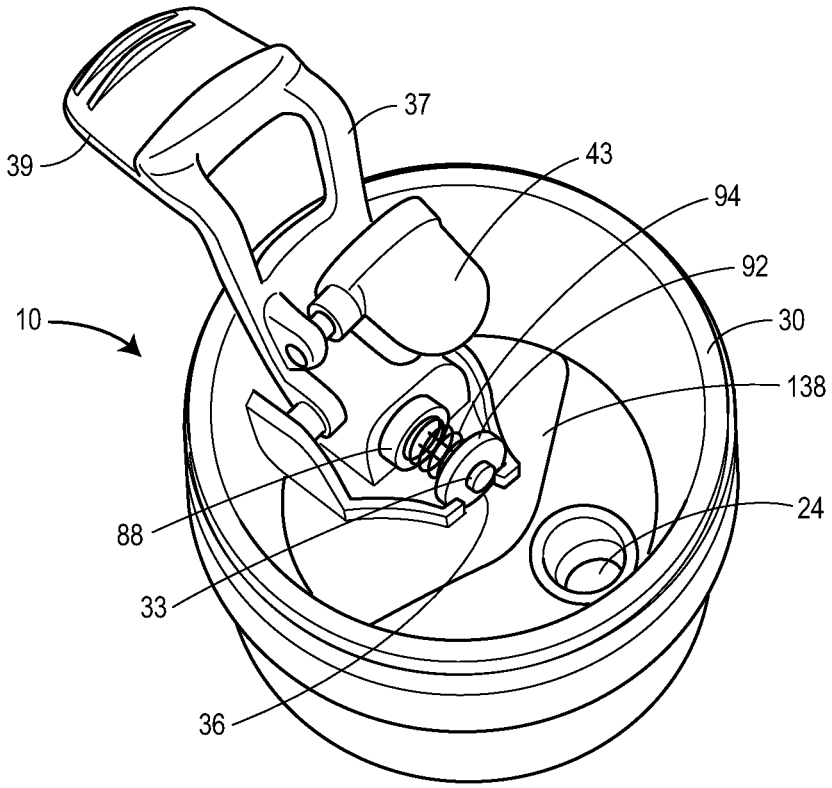
FIG. 8A is a perspective top view of an embodiment of the lid assembly with the locking member in an unlocked second position.

As illustrated in FIG. 3A, a first portion 143 of the main portion 82 may be slidably disposed within the button aperture 31 and a second portion 193 of the main portion 82 may be disposed within the skirt interior 90 such that the first end 36 of the button portion 33 is disposed in the skirt interior 90. As illustrated in FIGS. 3A, 3B, and 8A, a support tab 92 may extend from (and be non-movably secured to) the bottom surface 20 of the base portion 14 towards the second end 58 of the skirt portion 30, and the support tab 92 may have an aperture 93 that slidably supports a portion of the main portion 82 of the button member 33 as the button member 33 translates from the closed first position to the open second position. The support tab 92 may be planar and may have a rectangular or square portion with a rounded end portion, and the support tab 92 may be aligned with the Y-Z plane of the reference coordinate system of FIGS. 3A and 3B, and the support tab 92 may be disposed between the seal 88 and the first end 36 of the button member 33. A biasing element 94 (illustrated in FIG. 8A), such as a coil spring, may be disposed around a portion of the main portion 82 and between the seal 88 and the support tab 92, and the biasing element 94 biases the seal 88 (and the button member 33) into the closed first position.

Figure 5A:
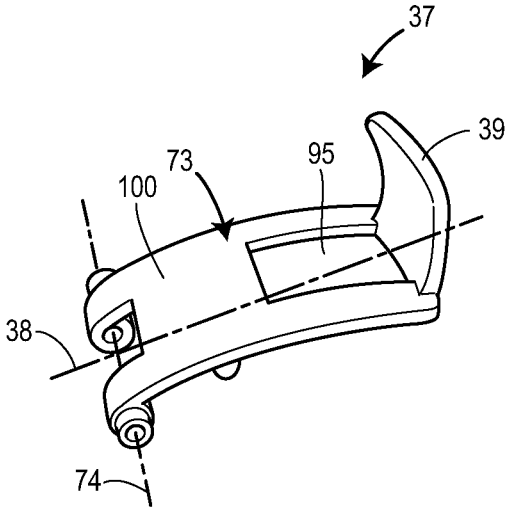
FIG. 5A is a perspective view of an embodiment of a locking member of the lid assembly.
Figure 5B:
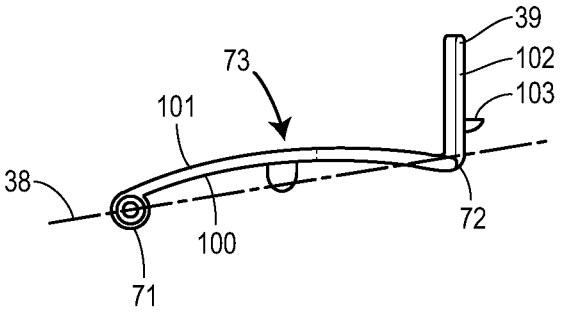
FIG. 5B is a side view of the embodiment of FIG. 5A.
Figure 5C:
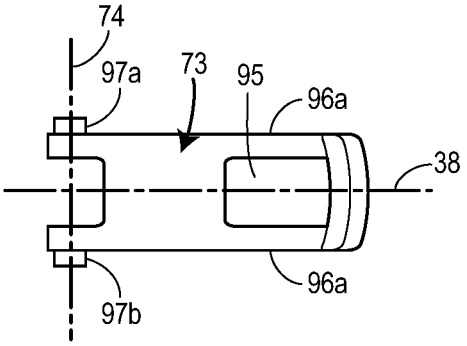
FIG. 5C is a top view of the embodiment of FIG. 5A.

As illustrated in FIGS. 3A, 3B, the lid assembly 10 may also include the displaceable seal assembly 41, and the displaceable seal assembly 41 may include a locking member 37 that may be pivotable from a locked first position (see FIG. 3B) into an unlocked or unsecured second position (illustrated in FIG. 8B) that allows for the cleaning of portions of the displaceable seal assembly 41 or portions of the fluid aperture 24, for example. As illustrated in FIGS. 5A to 5C, the locking member 37 may be elongated and may extend along a longitudinal axis 38 from a first end 71 to a longitudinally-opposite second end 72. An intermediate portion 73 may be disposed between the first end 71 and the second end 72. The locking member 37 may have a top surface 100 and an opposite bottom surface 101. A window 95 may be disposed within or through the locking member 37, and the window 95 may longitudinally extend from a first point at or adjacent to the intermediate portion 73 to a second point at or adjacent to the second end 72. As illustrated in FIG. 5C, the window 95 may laterally extend from a first point inwardly adjacent to a first lateral edge 96*a* to a second point inwardly adjacent to a second lateral edge 96*b*. The locking member 37 may be slightly cambered or curved when viewed along the axis of rotation 74. That is, the first end 71 and the second end 72 may intersect or be adjacent to the longitudinal axis 38 when viewed along the axis of rotation 38, but the intermediate portion 73 may be offset from the longitudinal axis 38. In other embodiments, the locking member 37 may be planar or substantially planar when viewed along the axis of rotation 74. The locking member 37 may have a constant (or substantially constant) cross-sectional shape in a direction aligned with the Y-axis of the reference coordinate system of FIGS. 3A and 3B (or in a direction aligned with the axis of rotation 74).

The first end 71 of the locking member 37 may be pivotably coupled to a portion of the skirt portion 30 and/or a portion of the bottom surface 20 of the base portion 14. For example, as illustrated in FIG. 8B, a pair of projections 97*a*, 97*b* may each outwardly extend along the axis of rotation 74 from a point at the first end 71 of the locking member 37, and each projection may be rotatably received in an aperture 98*a*, 98*b* of a corresponding support tab 99*a*, 99*b* secured to one or both of the skirt portion 30 and the bottom surface 20 of the base portion 14.

Figure 8B:
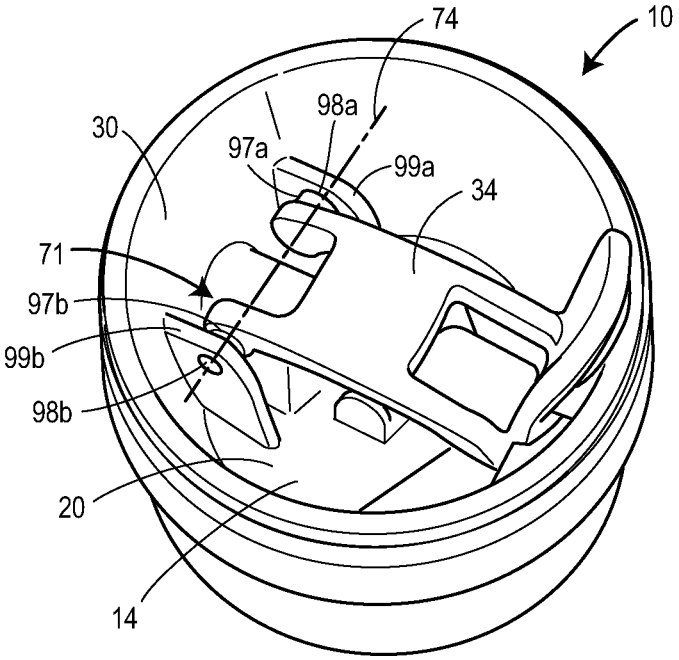
FIG. 8B is a perspective top view of an embodiment of the lid assembly with the locking member in a first position.

The locking member 37 may be pivotable about an axis of rotation 74 from the closed first position (illustrated in FIGS. 3A, 3B, and 8B) to an unlocked or unsecured second position (illustrated in FIG. 8B). In the closed first position, the top surface 100 faces the bottom surface 20 of the base portion 14. The axis of rotation 74 may be parallel to the Y-axis of the reference coordinate system of FIGS. 3A and 3B. Specifically, the axis of rotation 74 may be normal to the longitudinal axis 38 of the locking member 37, and the axis of rotation 74 may be normal to the longitudinal axis 34 of the button member 33 (illustrated in FIG. 3A).

A locking tab 39 may be disposed at or adjacent to the second end 72 of the locking member 37, and the locking tab 39 may extend from the bottom surface 101 in a direction normal or generally normal to the longitudinal axis 39. As illustrated in FIG. 3B, the locking tab 39 may have an outer surface 102 having a rib 103 that is adapted to engage a corresponding rib 104 of the skirt portion 30 when the locking member 37 is in the closed first position to releasably maintain the locking member 37 is in the closed first position. To rotationally displace the locking member 37 from the closed first position (of FIG. 3B) to the unlocked second position (of FIG. 8A), the locking tab 39 may first be displaced by the user towards the first end 71 of the locking member 37 such that the rib 103 clears the rib 104 of the skirt portion 30 prior to rotation about the axis of rotation 74. In the unlocked second position, components of the displaceable seal assembly 41, for example, may be cleaned. The locking member 37 may be rotated from the unlocked second position to the closed first position by reversing the process. To facilitate the user accessing the locking tab 39, an end portion of the locking tab 39 may extend beyond the second end 58 of the skirt portion 30.

Figure 9A:
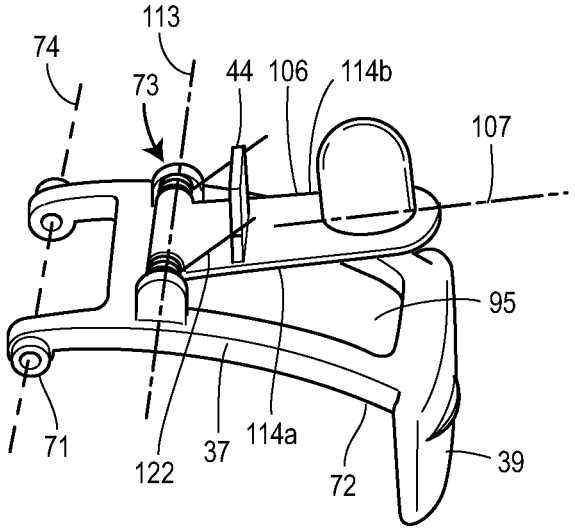
FIG. 9A is a perspective top view of an embodiment of the locking member and seal arm.
Figure 9B:
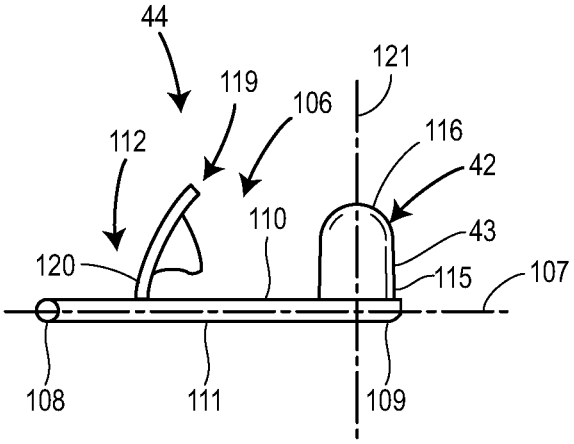
FIG. 9B is a side view of an embodiment of the seal arm.

As illustrated in FIGS. 3A, 3B, 9A and 9B, the displaceable seal assembly 41 may also include a seal arm 106. As illustrated in FIG. 9B, the seal arm 106 may be elongated and may extend along a longitudinal axis 107 from a first end 108 to a longitudinally-opposite second end 109, and an intermediate portion 112 may be disposed between the first end 108 and the second end 109. The seal arm 106 may be movable or pivotable relative to the locking member 37. That is, the first end 108 of the seal arm 106 may be pivotably coupled to the intermediate portion 73 of the locking member 37 (illustrated in FIG. 9A), and the seal arm 67 may be pivotable about an axis of rotation 113 from a closed first position (corresponding to the closed first position of the displaceable seal assembly 41 of FIG. 3B) to an open second position (corresponding to the closed first position of the displaceable seal assembly 41 of FIG. 3A). The seal arm 106 may have a first lateral edge 114*a* and a second lateral edge 114*b* that may be parallel, and the lateral distance between the first lateral edge 114*a* and the second lateral edge 114*b* may be less than the lateral width of the window 95 of the locking member 37 such that the second end 109 of the seal arm 106 may be disposed within or through the window 95 when the seal arm 106 is in the open second position. The seal arm 106 may have a (top) first surface 110 and an opposite (bottom) second surface 111. The first surface 110 of the seal arm 106 may face the bottom surface 20 of the base portion 14 when the seal arm 106 is in the closed first position and when the locking member 37 is in the closed first position.

The first portion 42 of the displaceable seal assembly 41 may be disposed at or adjacent to the second end 109 of the seal arm 106, and the first portion 42 includes a seal member 43. The seal member 43 may extend away from the first surface 110 of the seal arm 106 towards the bottom surface 20 of the base portion 14 when the seal arm 106 is in the closed first position (and when the locking member 37 is in the closed first position). That is, a longitudinal axis 121 of the seal member 43 may be normal to the longitudinal axis 107 of the seal arm 106. The seal member 43 may have a body portion 115 that is substantially cylindrical (e.g., substantially symmetrically formed about the longitudinal axis 121) and an end portion 116 that may be substantially spherical and may be sized to be received into or against the end portion 29 of the fluid aperture 24 (e.g., an end portion of the boss 28, as illustrated in FIG. 2A). Of course, other shapes are possible for the body portion 115 and the end portion 116. The end portion 116 (or the end portion 116 and the body portion 115) may be made of a resilient material, such as rubber, thermoplastic elastomer, or the like, and the body portion 115 may have an internal recess 117 that is adapted to receive a securement member 118 coupled to the seal arm 106, as illustrated in FIG. 3B. As previously explained, the seal member 43 (e.g., the end portion 116 of the seal member 43) may be adapted to sealingly engage a portion of the fluid aperture 24 when the displaceable seal assembly 41 is in the closed second position.

The second portion 44 of the displaceable seal assembly 41 may be coupled to the first portion 42. That is, the second portion 44 may be rigidly (i.e., non-movably) coupled to the seal arm 106 at or adjacent to the intermediate portion 112 of the seal arm 106. The second portion 44 may include an engagement tab 119 that may extend away from the first surface 110 of the seal arm 106 towards the bottom surface 20 of the base portion 14 when the seal arm 106 is in the open first position (and when the locking member 37 is in the open first position). The engagement tab 119 may have a contact surface 120 that may face the first end 108 of the seal arm 106. The second portion 44 (e.g., the contact surface 120) may be adapted to be contacted by the first end 36 of the button member 33 such that when the button member 33 displaces from the closed first position to the open second position, the first end 36 of the button member 33 contacts the second portion 44 of the displaceable seal assembly 41 (e.g., the contact surface 120) and translates (e.g., pivots) the seal arm 106 from the open second position to the closed first position (about the axis or rotation 113 and away from the first end 71 of the locking member 37) such that the displaceable seal assembly 41 is in (or pivots into) the open second position.

As illustrated in FIG. 9A, one or more biasing members 122 (e.g., springs) may be coupled to the intermediate portion 73 of the locking member 37 and a portion of the engagement tab 119, and the one or more biasing members 122 bias the seal member 43 (e.g., the end portion 116 of the seal member 43) towards the fluid aperture 24 (e.g., to sealingly engage the fluid aperture 24) when the seal arm 106 is in the closed first position and the open second position. Accordingly, when the button member 33 displaces from the open second position to the closed first position, the contact surface 120 of the engagement tab 119 is biased into contact with the first end 36 of the button member 33 such that the seal arm 106 pivots from the open second position to the closed first position (about the axis or rotation 113) such that the displaceable seal assembly 41 is in (or pivots into) the closed first position.

As illustrated in FIGS. 3A, 3B, 7A, and 7B, the lid assembly 10 includes the locking assembly 45, and the locking assembly 45 may be adapted to selectively lock to prevent accidental displacement of the button member 33. The locking assembly 45 includes the cover portion 46 that may be rotatably coupled to the base portion 14. The cover portion 46 may be shaped and dimensioned as to not cover the entire top surface 16 of the base portion 14. regardless of the rotational position of the cover portion 24 about the lid axis 23. As illustrated in FIGS. 7A and 7B, the cover portion 45 may have a central portion 75 defined by a perimeter edge 77 and an edge portion 76 disposed around the perimeter edge 77 of the central portion 75. A first portion 123 of the perimeter edge 77 may be shaped and dimensioned to correspond to the top perimeter edge 18 of the base portion (illustrated in FIG. 2A). That is, the first portion 123 of the perimeter edge 77 may have the shape of a segment of a circle (e.g., a 190° to 270° segment of a circle). The perimeter edge 77 may also include a second portion 124 that may be non-circular and may be liner or substantially linear, and the second portion 124 may be offset from a center 125 of a reference circle having the same diameter as the first portion 123 of the perimeter edge 77. The center 125 may be aligned with the lid axis 23 when the cover portion 46 is secured to the base portion 14. The central portion 75 may have a top surface 126 and an opposite bottom surface 127, and the bottom surface 127 may face the top surface 16 of the base portion 14. The central portion 75 may have a slightly concave shape to correspond to the slightly concave shape of a portion (or all) of the top surface 16 of the base portion 14.

Referring to FIGS. 7A and 7B, the edge portion 76 may be disposed around a portion (e.g., the first portion 123) of the perimeter edge 77. The edge portion 76 may extend upwardly (i.e., away from the top surface 126) and may be defined by a top inner wall 130 and a top outer wall 131. An interior surface 132 of the top inner wall 130 may correspond in shape to the interior surface 69 of the ridge portion 32 (see FIG. 2B) and an interior surface 133 of the top outer wall 131 may correspond in shape to the exterior surface 70 of the ridge portion 32 (see FIG. 2B). The interior surface 132 of the top inner wall 130 and the interior surface 133 of the top outer wall 131 may cooperated to form the channel 47, and the ridge portion 32 (illustrated in FIG. 2A) may be received (e.g., slidably received) into a channel 47 (e.g., when the cover portion 46 is rotated relative to the base portion 14 from the unlocked first position to the locked second position, and vice versa, about the lid axis 23).

Referring to FIG. 7B, the cover portion 46 may include a cover projection 134 extending from the bottom surface 127 of the central portion 75. The cover projection 134 may be elongated and extend along a curved (or semicircular) reference axis 135 from a first lateral end 136*a* and a radially-opposite second lateral end 136*b*. The reference axis 135 may be semi-circular and may have a center point aligned with the center 125 of the reference circle of the perimeter edge 77 (and/or the lid axis 23). The cover projection 134 may be sized and dimensioned to be slidably disposed within an intermediary recess 137 (see FIG. 6A) of an intermediary portion 138 in a manner that will be discussed in greater detail in a following section.

The cover portion 46 may be rotatably coupled to the base portion 14 in any suitable way. For example, as illustrated in FIG. 7B, a recess 128 may be disposed on the bottom surface 127, and the recess 128 may be adapted to receive a pin 129 (illustrated in FIG. 3A) that may be secured to the base portion 14. The pin 129 may be coaxially-aligned with the lid axis 23, and the recess may also be coaxially-aligned with the lid axis 23 such that the cover portion 46 rotates about the lid axis 23 from the unlocked first position (illustrated in FIG. 3A) to the locked second position (illustrated in FIG. 3B).

Referring to FIGS. 3A, 3B, 6A, and 6B, the locking assembly 45 may also include the intermediary portion 138 that may be rotatably coupled to at least one of the base portion 14 or the cover portion 46. As illustrated in FIGS. 7A and 7B, the intermediary portion 138 may be defined by a perimeter edge 77 and an edge portion 76 disposed around the perimeter edge 139. A first portion 140 of the perimeter edge 139 may have the shape of a segment of a circle (e.g., a 170° to 230° segment of a circle), and the diameter of the circle may less than the diameter of the diameter of the segment of the first portion 123 of the perimeter edge 77 of the cover portion 46. An aperture 145 may be disposed through the center 144 of the circle, and the center 144 of the circle may be aligned with the lid axis 23. The aperture 145 may receive the pin 129 (illustrated in FIG. 3A) to couple the intermediary portion 138 to the base portion 14 and/or the cover portion 46 such that the intermediary portion 138 is pivotable about the lid axis 23. A reference axis 146 may be normal to and intersect the lid axis 23 and may bisect the first portion 120.

The perimeter edge 139 may also include a second portion 141 and a third portion 142. Each of the second portion 141 and the third portion 142 may have a first end portion that extends from a respective end of the first portion 123, and the second portion 141 and the third portion 142 may form an angle between 40° to 60° with the reference axis 146. In some embodiments, the second portion 141 and the third portion 142 may form the same angle with the reference axis 146. Each of the second portion 141 and the third portion 142 may have a second end portion that intersects a respective end of a fourth portion 147 of the perimeter edge 130. The fourth portion 147 may have the shape of a segment of a circle (e.g., a 60° to 110° segment of a circle), and the circle may have a diameter less than the first portion 140 and may be centered about the center 144 of the first portion 140. The reference axis 146 may bisect the fourth portion 147.

The intermediary portion 138 may have a top surface 148 and an opposite bottom surface 149. The bottom surface 149 may face (and/or be adjacent to) a portion of the top surface 16 of the base portion 14 and the top surface 148 may face (and/or be adjacent to) a portion of the bottom surface 127 of the central portion 75 of the cover portion 46. The top surface 148 and/or the bottom surface 149 may be contoured to conform to the bottom surface 127 of the central portion 75 of the cover portion 46 and the top surface 16 of the base portion 14, respectively.

Figure 6A:
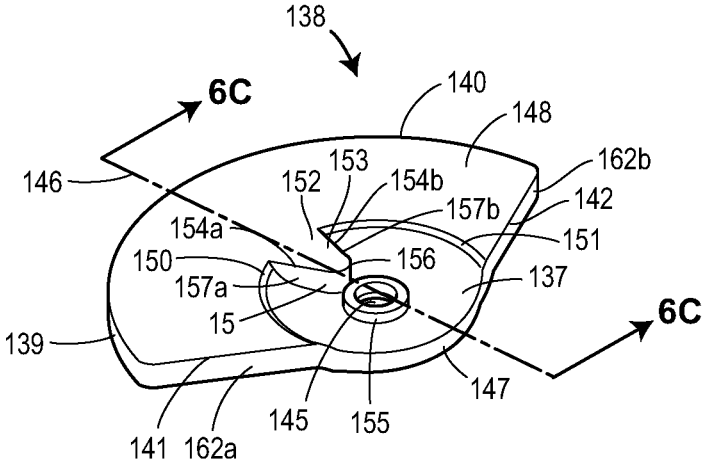
FIG. 6A is a perspective top view of an embodiment of an intermediary portion of the lid assembly.
Figure 6B:
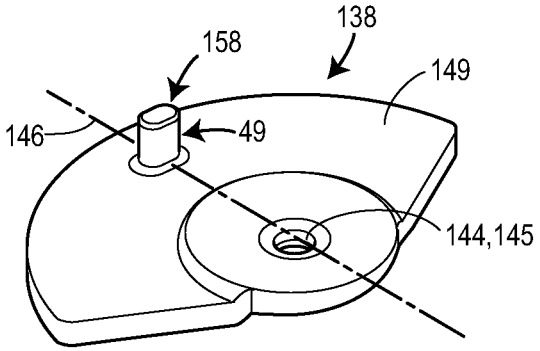
FIG. 6B is a perspective bottom view of the embodiment of FIG. 6A.
Figure 6C:
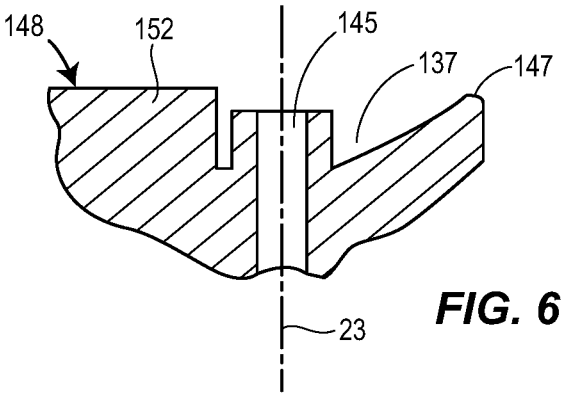
FIG. 6C is a partial cross-sectional view along line 6C-6C of the embodiment of FIG. 6A.

The intermediary recess 137 may be formed in the top surface 148, and as illustrated in FIG. 6C, the intermediary recess 137 may gradually decrease in depth as the intermediary recess 137 extends away from the aperture 145 and/or the lid axis 23. Referring to FIG. 6A, the intermediary recess 137 may be defined by a first edge 150 and a second edge 151, and each of the first edge 150 and a second edge 151 may be a segment of a circle having an equal diameter and centered about the lid axis 23. The intermediary recess 137 may be sized and dimensioned to receive the cover projection 135 such that the cover projection 135 may rotate about the lid axis 23 within the intermediary recess 137.

A contact member 152 may be disposed within or adjacent to the intermediary recess 137. The contact member 152 may be elongated and may extend along the reference axis 146. A top surface 153 of the contact member 152 may be coextensive with the top surface 148 of the intermediary portion 138. The top surface 153 may be defined by two side edges 154*a*, 154*b* that gradually converge as the side edges 154*a*, 154*b* extend towards the aperture 145 (and/or the lid axis 23). Each of the two side edges 154*a*, 154*b* may have an end portion that may be adjacent to a raised boss 155 that surrounds the aperture 145. A rounded front edge 156 may have ends that each extend from the end portions of the two side edges 154*a*, 154*b*. Each of the two side edges 154*a*, 154*b* may form an angle between 10° and 30° with the reference axis 146, and angles may be equal. A maximum distance between the end portions of the two side edges 154*a*, 154*b* may be approximately equal to the length of the two side edges 154*a*, 154*b*. A wall may downwardly extend from each of the two side edges 154*a*, 154*b* to form a first lateral end 157*a* and a second lateral end 157*b*, respectively, and the first lateral end 157*a* may be radially-opposite of the second lateral end 157*b*.

Figure 10:
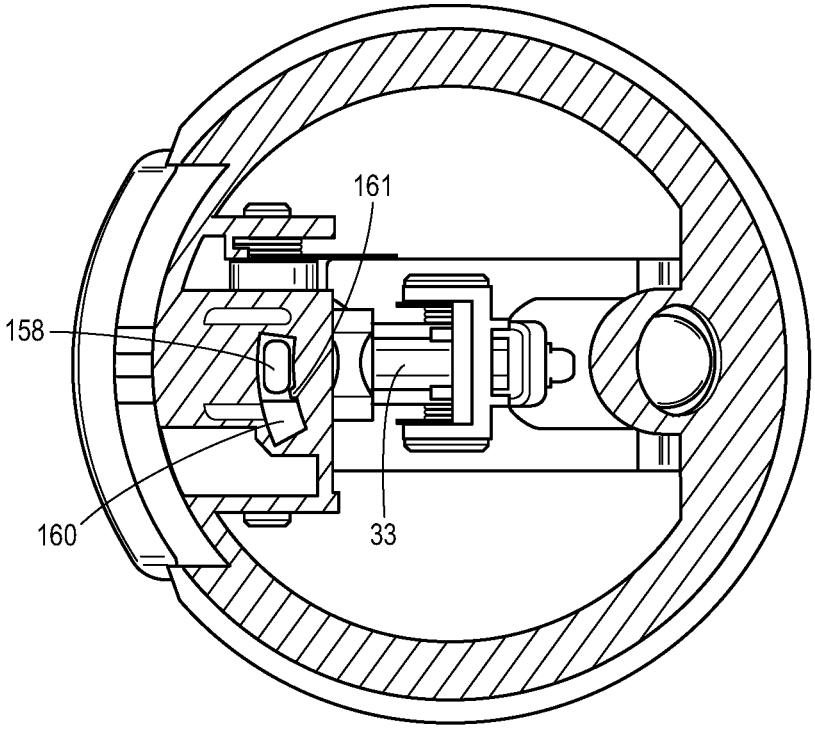
FIG. 10 is a cross-sectional top view of an embodiment of the lid assembly with the locking member in a locked first position taken along line 10-10 of the embodiment of FIG. 3B.
Figure 11A:
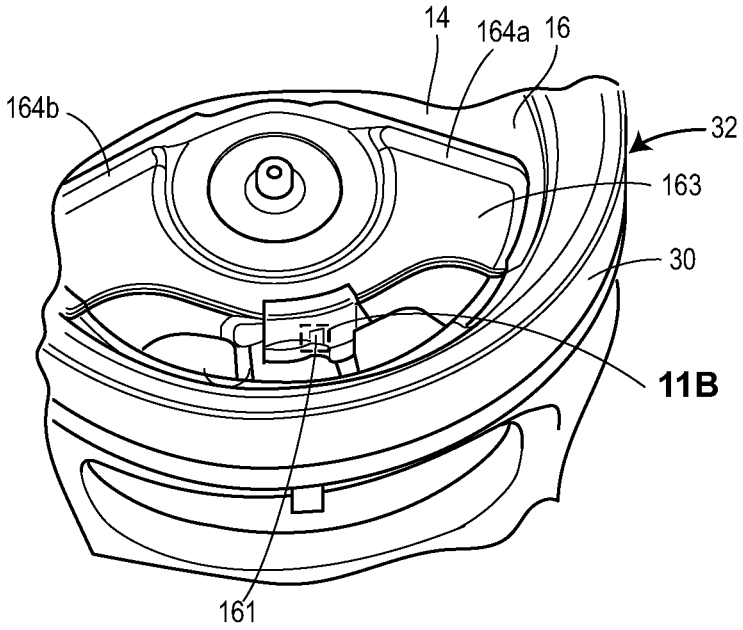
FIG. 11A is a perspective view of an embodiment of the base member with the cover portion and intermediate portion removed for clarity.
Figure 11B:
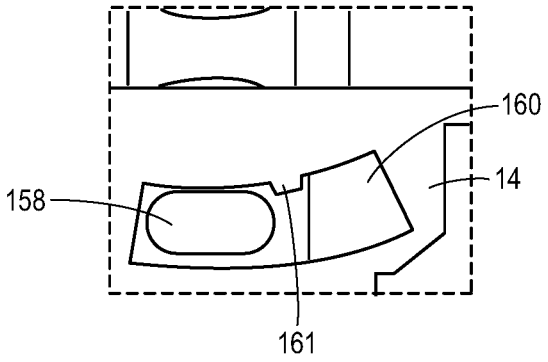
FIG. 11B is a top view of an embodiment of a tab aperture formed in the base portion.

The intermediary portion 138, which is coupled to the cover member 46, may also include the second locking engagement portion 49. Specifically, the second locking engagement portion 49 may be an intermediary projection 158 extending from the bottom surface 149 of the intermediary portion 138. The intermediary projection 158 may be elongated and may extend along an axis 159 parallel to the lid axis 23. The intermediary projection 158 may have any suitable cross-sectional shape to suitably interact with the first locking engagement portion 49 to create contact or an obstruction that prevents the button member 33 from displacing from the second closed position to the first open position. For example, the intermediary projection 158 may have a rectangular cross-sectional shape (when viewed along the axis 159), and the corners of the rectangle may be rounded to match a chamfer of the locking recess 40 of the button member 33 to bias the intermediary projection 158 into the locking recess 40. The intermediary projection 158 may extend through a radial tab aperture 160 (illustrated in FIGS. 3A, 3B, and 10) that extends though the top surface 16 of the base portion 14 to the bottom surface 20 of the base portion 14. As illustrated in FIGS. 10, 11A, and 11B, a detent feature 161 may inwardly project from a surface of the tab aperture 160, and the detent feature 161 may positively lock (or retain) the intermediary projection 158 within the locking recess 40 (illustrated in FIG. 11B).

As previously explained, the skilled person would recognize that the first locking engagement portion 49 may include any feature or combination of features that can engage with the second locking engagement portion 48 to prevent or limit displacement of the button member 33 from the closed first position to (or towards) the open second position. Accordingly, in other embodiments, the first locking engagement portion 49 may be a projection or tab that may be received in a second locking engagement portion 48 that may be a recess or channel.

So configured, the intermediary projection 158 may be adapted to be rotatably inserted and removed from a portion of the locking recess 40 of the button member 33 such that when the intermediary portion 138 is in the locked second position, at least a portion of the intermediary projection 158 is disposed within the portion of the locking recess 40 of the button member 33 and such that when the intermediary portion 138 is in the unlocked first position, no portion of the intermediary projection 158 is disposed within the portion of the locking recess 40 of the button member 33.

When it is desired by a user to lock the lid assembly 10 secured to the container 12, the user first rotates the cover portion 46 about the lid axis 23 from the unlocked first position (illustrated in FIG. 3A) to (or towards) the locked second position (illustrated in FIG. 3B). During this rotation of the cover portion 46, the first lateral end 136*a* of the cover projection 134 (see FIG. 7B) eventually contacts the first lateral end 157*a* of the contact member 152 of the intermediary portion 138 (see FIG. 6A), and continued rotation of the cover portion 46 rotates the intermediary portion 138 from the unlocked first position to the locked second position. Rotation of the cover portion 46 and the intermediary portion 138 continues until, as illustrated in FIG. 2C, a first side wall 162*a* (partially defined by the second portion 141) contacts a first wall 164*a* of a recess 163 that receives a portion of the intermediary portion 138. When disposed in the recess 163, the top surface 148 of the intermediary portion 138 may be flush with (or slightly offset from) the top surface 16 of the base portion 14, as illustrated in FIG. 3A.

Upon this contact, the first locking engagement portion 49 may engage with the second locking engagement portion 48 to prevent or limit displacement of the button member 33 from the closed first position to (or towards) the open second position. More specifically, upon this contact, at least a portion of the intermediary projection 158 is disposed within at least a portion of the locking recess 40 of the button member 33 and the button member 33 cannot be depressed from the closed second position towards the open first position. Accidental leakage of fluid out of the drinking aperture 24 is therefore avoided. Also in this locked configuration, the portion 175 of the ridge portion 32 (see FIG. 3B) adjacent to the fluid aperture 24 is covered by the cover portion 46, thereby keeping the drinking area clean and free of debris.

To unlock the lid assembly 10 secured to the container 12, the user first rotates the cover portion 46 about the lid axis 23 from the locked second position (illustrated in FIG. 3B) to (or towards) the unlocked first position (illustrated in FIG. 3A). During this rotation of the cover portion 46, the second lateral end 136*b* of the cover projection 134 (see FIG. 7B) eventually contacts the second lateral end 157*b* of the contact member 152 of the intermediary portion 138 (see FIG. 6A), and continued rotation of the cover portion 46 rotates the intermediary portion 138 from the locked second position to the unlocked first position. Rotation of the cover portion 46 and the intermediary portion 138 continues until, with reference to FIG. 2C, a second side wall 162*b* (partially defined by the third portion 142 of FIG. 6A) contacts a second wall 164*b* of the recess 163 that receives a portion of the intermediary portion 138. Upon this contact, the first locking engagement portion 49 may disengage (or not engage) with the second locking engagement portion 48 to thereby allow displacement of the button member 33 from the closed first position to (or towards) the open second position. More specifically, upon this contact, the intermediary projection 158 is disposed outside or out of engagement with the locking recess 40 of the button member 33 and the button member 33 can be depressed from the closed second position towards the open first position by a user. In this unlocked configuration, the cover portion 46 is rotated away from the fluid aperture 24 to allow for easy access to the drinking area.

While various embodiments have been described above, this disclosure is not intended to be limited thereto. Variations can be made to the disclosed embodiments that are still within the scope of the appended claims.

What is claimed is:

1. A lid assembly adapted to be removably secured to a container, the lid assembly comprising:

a base portion having a top surface having a top perimeter edge and a bottom surface having a bottom perimeter edge, wherein a fluid aperture extends through the base portion from the top surface to the bottom surface;

an elongated button member coupled to the base portion, the button member extending along a longitudinal axis from a first end to a longitudinally-opposite second end, the button member being displaceable along the longitudinal axis from a closed first position to an open second position, wherein the button member has a first locking engagement portion, and;

a displaceable seal assembly coupled to the base portion and displaceable from a closed first position to an open second position, the displaceable seal assembly comprising:

a first portion having a seal member, the seal member adapted to sealingly engage a portion of the fluid aperture when the displaceable seal assembly is in the closed first position and adapted to not sealingly engage the portion of the fluid aperture when the displaceable seal assembly is in the open second position;

a second portion coupled to the first portion, the second portion adapted to be contacted by the button member such that when the button member displaces from the closed first position to the open second position, the button member contacts the second portion of the displaceable seal assembly and translates the displaceable seal assembly from the closed first position to the open second position; and a locking assembly, the locking assembly comprising:

a cover portion rotatably coupled to the base portion, the cover portion being rotationally displaceable relative to the base portion from an unlocked first position to a locked second position about a lid axis, the cover portion being coupled to a second locking engagement portion, wherein at least a portion of the second locking engagement portion is disposed within a portion of the first locking engagement portion of the button member when the cover portion is in the locked second position such that displacement of the button member from the closed first position towards the open second position is prevented or limited, thereby preventing the displacement of the seal assembly from the closed first position to the open second position, and wherein no portion of the second locking engagement portion is engaged with the portion of the first locking engagement portion of the button member when the cover portion is in the unlocked first position such that the button member is adapted to be displaced from the closed first position to the open second position to displace the seal assembly from the closed first position to the open second position.

2. The lid assembly of claim 1, wherein a ridge portion extends from the top perimeter edge of the top surface of the base portion, the ridge portion having an exterior surface and an interior surface, and wherein at least a portion of the ridge portion is received into a channel formed by the edge portion of the cover portion.

3. The lid assembly of claim 1, further comprising:

a skirt portion extending from the bottom perimeter edge of the bottom surface of the base portion, the skirt portion having an exterior surface, and wherein a portion of the exterior surface of the skirt portion is threaded and adapted to engage a threaded portion of the container, wherein a button aperture is defined in the skirt portion, and the button aperture extends along a button axis.

4. The lid assembly of claim 3, wherein at least a portion of the button member is disposed within the button aperture.

5. The lid assembly of claim 3, wherein the exterior surface of the skirt portion has a cylindrical shape.

6. The lid assembly of claim 1, wherein the displaceable seal assembly includes a locking member, and wherein the locking member is in a closed first position relative to the base portion.

7. The lid assembly of claim 1, wherein the second portion of the displaceable seal assembly is biased into contact with the button member as the button member translates from the closed second position to the open first position.

8. A lid assembly adapted to be removably secured to a container, the lid assembly comprising:

a base portion having a top surface having a top perimeter edge and a bottom surface having a bottom perimeter edge, wherein a fluid aperture extends through the base portion from the top surface to the bottom surface;

an elongated button member coupled to the base portion, the button member extending along a longitudinal axis from a first end to a longitudinally-opposite second end, the button member being displaceable along the longitudinal axis from a closed first position to an open second position, wherein the button member has a first locking engagement portion, and;

a displaceable seal assembly coupled to the base portion and displaceable from a closed first position to an open second position, the displaceable seal assembly comprising:

a first portion having a seal member, the seal member adapted to sealingly engage a portion of the fluid aperture when the displaceable seal assembly is in the closed first position and adapted to not sealingly engage the portion of the fluid aperture when the displaceable seal assembly is in the open second position;

a second portion coupled to the first portion, the second portion adapted to be contacted by the button member such that when the button member displaces from the closed first position to the open second position, the button member contacts the second portion of the displaceable seal assembly and translates the displaceable seal assembly from the closed first position to the open second position; and a locking assembly, the locking assembly comprising:

a cover portion rotatably coupled to the base portion, the cover portion being rotationally displaceable relative to the base portion from an unlocked first position to a locked second position about a lid axis, the cover portion being coupled to a second locking engagement portion, wherein at least a portion of the second locking engagement portion is engaged with a portion of the first locking engagement portion of the button member when the cover portion is in the locked second position such that displacement of the button member from the closed first position towards the open second position is prevented or limited, thereby preventing the displacement of the seal assembly from the closed first position to the open second position, wherein no portion of the second locking engagement portion is engaged with the portion of the first locking engagement portion of the button member when the cover portion is in the unlocked first position such that the button member is adapted to be displaced from the closed first position to the open second position to displace the seal assembly from the closed first position to the open second position, and wherein the cover portion of the locking assembly includes a cover projection extending from a bottom surface, the cover projection having a first lateral end and a radially-opposite second lateral end, and wherein the first locking engagement portion of the button member is a circumferential locking recess disposed on the button member.

9. The lid assembly of claim 8, wherein the locking assembly includes an intermediary portion rotatably coupled to at least one of the base portion or the cover portion, the intermediary portion being rotationally displaceable relative to the cover portion and/or the base portion from an open first position to a locked second position about the lid axis, wherein an intermediary recess is formed in the intermediary portion, the intermediary recess adapted to receive the cover projection, and wherein a contact member is disposed within or adjacent to the intermediary recess, the contact member having a first lateral end and a second lateral end radially-opposite of the first lateral end.

10. The lid assembly of claim 9, wherein the second locking engagement portion is an intermediary projection extending from a bottom surface of the intermediary portion, the intermediary projection extending through a tab aperture formed through the top and bottom surfaces of the base portion, wherein the intermediary projection is adapted to be rotatably inserted and removed from a portion of the locking recess of the button member such that when the intermediary portion is in the locked second position, at least a portion of the intermediary projection is disposed within the portion of the locking recess of the button member and such that when the intermediary portion is in the unlocked first position, no portion of the intermediary projection is disposed within the portion of the locking recess of the button member, and wherein when the cover portion is rotated from the unlocked first position to the locked second position, the first lateral end of the cover projection contacts the first lateral end of the contact member of the intermediary portion to rotate the intermediary portion from the unlocked first position to the locked second position, and wherein when the cover portion is rotated from the locked second position to the unlocked first position, the second lateral end of the cover projection contacts the second end of the contact member of the intermediary portion to rotate the intermediary portion from the locked second position to the unlocked first position.

11. A lid assembly adapted to be removably secured to a container, the lid assembly comprising:

a base portion having a top surface having a top perimeter edge and a bottom surface having a bottom perimeter edge, wherein a fluid aperture extends through the base portion from the top surface to the bottom surface;

an elongated button member coupled to the base portion, the button member extending along a longitudinal axis from a first end to a longitudinally-opposite second end, the button member being displaceable along the longitudinal axis from a closed first position to an open second position, wherein the button member has a first locking engagement portion, and;

a displaceable seal assembly coupled to the base portion and displaceable from a closed first position to an open second position, the displaceable seal assembly comprising:

a first portion having a seal member, the seal member adapted to sealingly engage a portion of the fluid aperture when the displaceable seal assembly is in the closed first position and adapted to not sealingly engage the portion of the fluid aperture when the displaceable seal assembly is in the open second position;

a second portion coupled to the first portion, the second portion adapted to be contacted by the button member such that when the button member displaces from the closed first position to the open second position, the button member contacts the second portion of the displaceable seal assembly and translates the displaceable seal assembly from the closed first position to the open second position; and a locking assembly, the locking assembly comprising:

a cover portion rotatably coupled to the base portion, the cover portion being rotationally displaceable relative to the base portion from an unlocked first position to a locked second position about a lid axis, the cover portion being coupled to a second locking engagement portion, wherein at least a portion of the second locking engagement portion is engaged with a portion of the first locking engagement portion of the button member when the cover portion is in the locked second position such that displacement of the button member from the closed first position towards the open second position is prevented or limited, thereby preventing the displacement of the seal assembly from the closed first position to the open second position, wherein no portion of the second locking engagement portion is engaged with the portion of the first locking engagement portion of the button member when the cover portion is in the unlocked first position such that the button member is adapted to be displaced from the closed first position to the open second position to displace the seal assembly from the closed first position to the open second position, wherein the displaceable seal assembly includes a locking member, and wherein the locking member is in a closed first position relative to the base portion, and wherein a first end of the locking member is pivotably coupled to a portion of the skirt portion and/or a portion of a bottom surface of the base portion, the locking member being pivotable about an axis of rotation from the closed first position to an unlocked second position, and the axis of rotation is normal to a longitudinal axis of the button member.

12. The lid assembly of claim 11, wherein the displaceable seal assembly includes a locking tab , the locking tab having an outer surface having a rib that is adapted to engage a corresponding rib coupled to the base portion.

13. The lid assembly of claim 12, wherein a skirt portion extends from the bottom perimeter edge of the bottom surface of the base portion, wherein the engagement portion is coupled to the skirt member when the locking member is in the closed first position.

14. A lid assembly adapted to be removably secured to a container, the lid assembly comprising:

a base portion having a top surface having a top perimeter edge and a bottom surface having a bottom perimeter edge, wherein a fluid aperture extends through the base portion from the top surface to the bottom surface;

an elongated button member coupled to the base portion, the button member extending along a longitudinal axis from a first end to a longitudinally-opposite second end, the button member being displaceable along the longitudinal axis from a closed first position to an open second position, wherein the button member has a first locking engagement portion, and;

a displaceable seal assembly coupled to the base portion and displaceable from a closed first position to an open second position, the displaceable seal assembly comprising:

a first portion having a seal member, the seal member adapted to sealingly engage a portion of the fluid aperture when the displaceable seal assembly is in the closed first position and adapted to not sealingly engage the portion of the fluid aperture when the displaceable seal assembly is in the open second position;

a second portion coupled to the first portion, the second portion adapted to be contacted by the button member such that when the button member displaces from the closed first position to the open second position, the button member contacts the second portion of the displaceable seal assembly and translates the displaceable seal assembly from the closed first position to the open second position; and a locking assembly, the locking assembly comprising:

a cover portion rotatably coupled to the base portion, the cover portion being rotationally displaceable relative to the base portion from an unlocked first position to a locked second position about a lid axis, the cover portion being coupled to a second locking engagement portion, wherein at least a portion of the second locking engagement portion is engaged with a portion of the first locking engagement portion of the button member when the cover portion is in the locked second position such that displacement of the button member from the closed first position towards the open second position is prevented or limited, thereby preventing the displacement of the seal assembly from the closed first position to the open second position, wherein no portion of the second locking engagement portion is engaged with the portion of the first locking engagement portion of the button member when the cover portion is in the unlocked first position such that the button member is adapted to be displaced from the closed first position to the open second position to displace the seal assembly from the closed first position to the open second position, wherein the displaceable seal assembly includes a locking member, and wherein the locking member is in a closed first position relative to the base portion, and wherein the displaceable seal assembly includes a seal arm, a first end of the seal arm being pivotably coupled to an intermediate portion of the locking member.

15. The lid assembly of claim 14, wherein the first portion of the displaceable seal assembly is disposed at or adjacent to a second end of the seal arm, the seal member extending from the seal arm towards the base portion when the seal arm is in the closed first position and when the locking member is in the closed first position.

16. The lid assembly of claim 14, wherein the second portion of the displaceable seal assembly comprises an engagement tab coupled to the seal arm at or adjacent to an intermediate portion of the seal arm, the engagement tab extending from the seal arm towards the base portion when the seal arm is in the closed first position and when the locking member is in the closed first position, wherein when the button member displaces from the closed first position to the open second position and when the locking member is in the closed first position, the button member contacts a portion of the engagement tab and pivots the seal arm from the closed first position to the open second position such that the seal assembly is in the open second position.

17. The lid assembly of claim 16, wherein a spring is coupled to the intermediate portion of the locking member and to the engagement tab, and the spring biases the seal member seal arm towards the fluid aperture when the seal arm is in the closed first position and the open second position.

18. The lid assembly of claim 14, wherein an axis of rotation of the seal arm is parallel to the axis of rotation of the locking member.

* * * * *